United States Patent [19]

Beckmann et al.

[11] 4,375,904

[45] Mar. 8, 1983

[54] LONGWALL MINERAL WINNING MACHINE WITH ADJUSTABLE CUTTING JET

[75] Inventors: Klaus Beckmann, Lunen; Kunibert Becker, Werl, both of Fed. Rep. of Germany

[73] Assignee: Gewerkschaft Eisenhütte Westfalia, Lunen, Fed. Rep. of Germany

[21] Appl. No.: 228,911

[22] Filed: Jan. 27, 1981

[30] Foreign Application Priority Data

Feb. 7, 1980 [DE] Fed. Rep. of Germany ..... 3004443

[51] Int. Cl.³ ..... E21C 25/60; E21C 25/68

[52] U.S. Cl. ..... 299/53; 299/17; 299/81

[58] Field of Search ..... 299/17, 43, 53, 81

[56] References Cited

U.S. PATENT DOCUMENTS

| | | | |
|---|---|---|---|
| 3,337,269 | 8/1967 | Mennekes et al. | 299/81 X |
| 4,181,363 | 1/1980 | Goris et al. | 299/17 |
| 4,239,290 | 12/1980 | Goris et al. | 299/17 X |
| 4,265,487 | 5/1981 | Barker | 299/17 X |

FOREIGN PATENT DOCUMENTS

| | | | |
|---|---|---|---|
| 621872 | 8/1978 | U.S.S.R. | 299/17 |
| 658271 | 4/1979 | U.S.S.R. | 299/17 |

*Primary Examiner*—Ernest R. Purser

*Attorney, Agent, or Firm*—Thompson, Birch, Gauthier & Samuels

[57] ABSTRACT

A shearer-type mineral winning machine has rotatable cutting drums supported by swinging arms at the ends of its main body. High-pressure water emission nozzles are supported by adjustable carriers in positions generally adjacent the drums to effect preliminary cuts in a mineral face just in advance of the cutting drums.

13 Claims, 4 Drawing Figures

LONGWALL MINERAL WINNING MACHINE WITH ADJUSTABLE CUTTING JET

BACKGROUND OF THE INVENTION

The present invention relates to mineral winning machines.

It is known to win coal or other mineral ores with so-called shearers which utilize rotary cutting drums and also with ploughs which employ non-rotary cutting tools. It is also known to provide high-pressure fluid emission nozzles to assist the normal mechanical tools. See, for example, German patent specification Nos. 1 274 544, 2 307 413, 2 548 952 and UK patent specification No. 672 336.

A general object of this invention is to provide an improved form of mineral winning machine.

A winning machine constructed in accordance with the invention employs at least one rotary cutting means, e.g. a drum or roller, equipped with cutters and high-pressure fluid emitting nozzles which are supported by a separate carrier near the drum which is adjustable in position. The carrier can be set forward in relation to the cutting drum and the nozzles then produce a preliminary kerfing cut or slot in the mineral face in advance of the cutting drum. Normally, the nozzles would discharge high-pressure jets of water with a pressure of at least 1000 bar. The carrier, although positioned in the vicinity of the cutting drum, is separate to the drum.

The machine can be equipped with two cutting drums, one at each end of a main body, and carriers with nozzles likewise at each end of the body. The cutting drums would usually be mounted on swingable arms pivoted to the machine body. The carriers can also be movably supported on the body by support means adjustable to bring the nozzles into selected positions. The nozzles can in general produce at least one preliminary slot in the mineral face in advance of the associated cutting drum relative to the direction of motion of the machine. The nozzles are preferably positioned however so that the nozzles provide preliminary cuts at the roof and floor level as the machine moves back and forth along the mineral face. These preliminary cuts assist the main winning work performed by the cutting drums by breaking up and loosening the mineral ore in the critical regions where the cutting profile defined by the drums adjoins the roof and floor levels.

The nozzle carriers can be adjustable vertically in relation to the cutting drums to position the nozzles as desired. The carriers are preferably elongate and the nozzles are spaced apart along the carriers so that each nozzle increases the depth of cut produced by the preceding one.

The nozzles can project perpendicular to the carriers or be inclined thereto.

The carriers can be pivotable about the axes of rotation of the cutting drums to adjust the nozzles in position. The support means for the carriers can take the form of further arms pivotably supporting the carriers for pivoting about axes parallel to the rotational axes of the drums. These arms themselves can be pivotably mounted to the machine body. Preferably the arms pivot about the axes of rotation of the drums. This form of support means for the carriers provides an ample range of adjustability for the operating position of the nozzles. Regardless of the working position of the cutting drums the carriers can be adjusted independently to cause the nozzles to discharge their high-pressure fluid jets either at the roof or floor level or at some intermediate location. Nevertheless, a preferred operating mode described in detail hereinafter has the drum at the leading end of the machine, relative to its direction of motion, positioned to cut near the roof and the drum at the lagging end of the machine positioned to cut near the floor. The carriers associated with the drums can then be positioned in corresponding manner to cause the nozzles to produce preliminary slots in advance of their respective cutting drums.

The fluid or water supplied to the nozzles can be conveyed via pipes or conduits conveniently situated within the arms supporting the cutting drums and the carriers and also, if desired, through the shafts pivotably mounting the support arms of the drums and rotatably mounting the drums.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
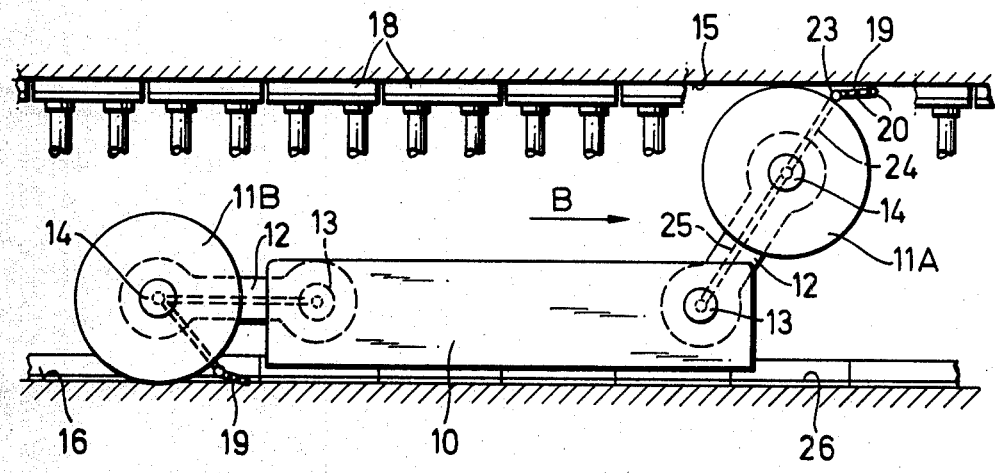
FIG. 1 is a diagrammatical representation of a mineral winning machine constructed in accordance with the invention.
Figure 2:
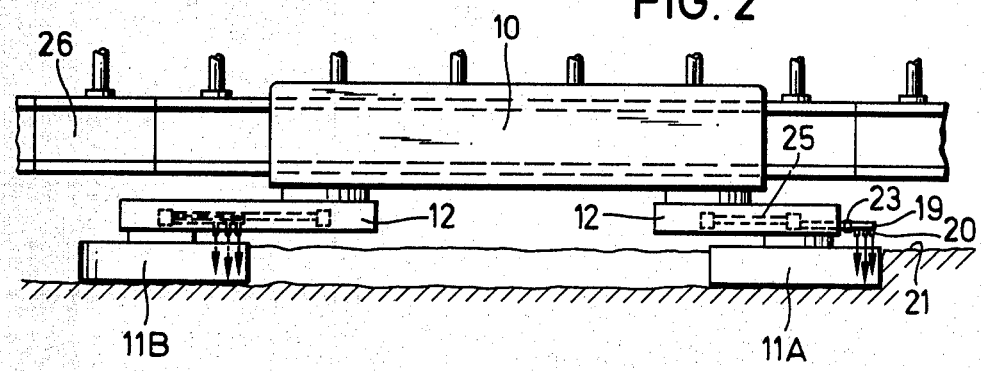
FIG. 2 is a plan view of the machine depicted inFIG. 1.

FIGS. 1 and 2 of the accompanying drawings show a mineral winning machine of the shearer type, i.e. equipped with rotary cutting means. Machines of this type are well known per se. The machine embodying the invention has a main body 10 which is guided for movement back and forth alongside a mineral face. The body 10 can be supported for the movement on a scraper-chain conveyor 26. The body 10 accommodates or supports drive means for effecting the movement of the machine as well as for driving its rotary cutting means. This cutting means takes the form of two rotatable cutting drums or rollers 11A, 11B mounted on shafts 14 on arms 12 which are themselves pivotably supported by shafts 13 on the end regions of the body 10. The arms 12 can be swung up and down to cause the cutting drums 11A, 11B to engage the mineral face 21 over different zones. The drums 11a, 11B are equipped with mechanical cutting tools in known manner. In addition, the cutting drums 11A, 11B are operably associated with hydraulic fluid emitting nozzles 20 which emit fluid jets, usually water jets, at high-pressure—generally at least 1000 bars. The nozzles 20 are mounted on carriers 19 in the general vicinity of the peripheries of the drums 11A, 11B.

Figure 3:
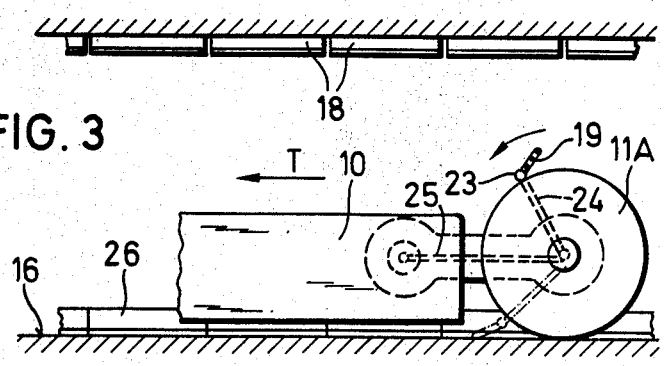
FIG. 3 is a view of part of the machine depicted in FIG. 1 during its movement in the opposite direction to that represented in FIG. 1.

During use, the machine is moved firstly in the direction of arrow B in FIG. 1. During this run the forward cutting drum 11A is positioned to detach mineral from the mineral face 21 in the upper zone of the face 21 while the lagging cutting drum 11B is positioned to detach mineral from the mineral face 21 in the lower zone of the face 21. Conveniently, these upper and lower zones may overlap. The drum 11A serves to define the roof surface 15 while the drum 11B serves to define the floor surface 16 as the winning process progresses. The roof of the working is supported as is known by advanceable supports equipped with hydraulic props and FIG. 1 depicts the roof bars 18 and part of the props of these supports. When the machine has been moved to the end of its run in the direction of arrow B in FIG. 1 the drive means reverses the direction of travel and the machine now moves in the direction of arrow T in FIG. 3. During this run the roles of the drums 11A, 11B reverse. Thus, the now-forward cutting drum 11B is raised to cut away the upper zone of the face 21 while the now lagging drum 11A is lowered to cut away the lower zone of the face 21. As the machine travels back and forth in the directions B and T the drums 11A, 11B thus win the mineral which is transported away by the conveyor 26.

Figure 4:
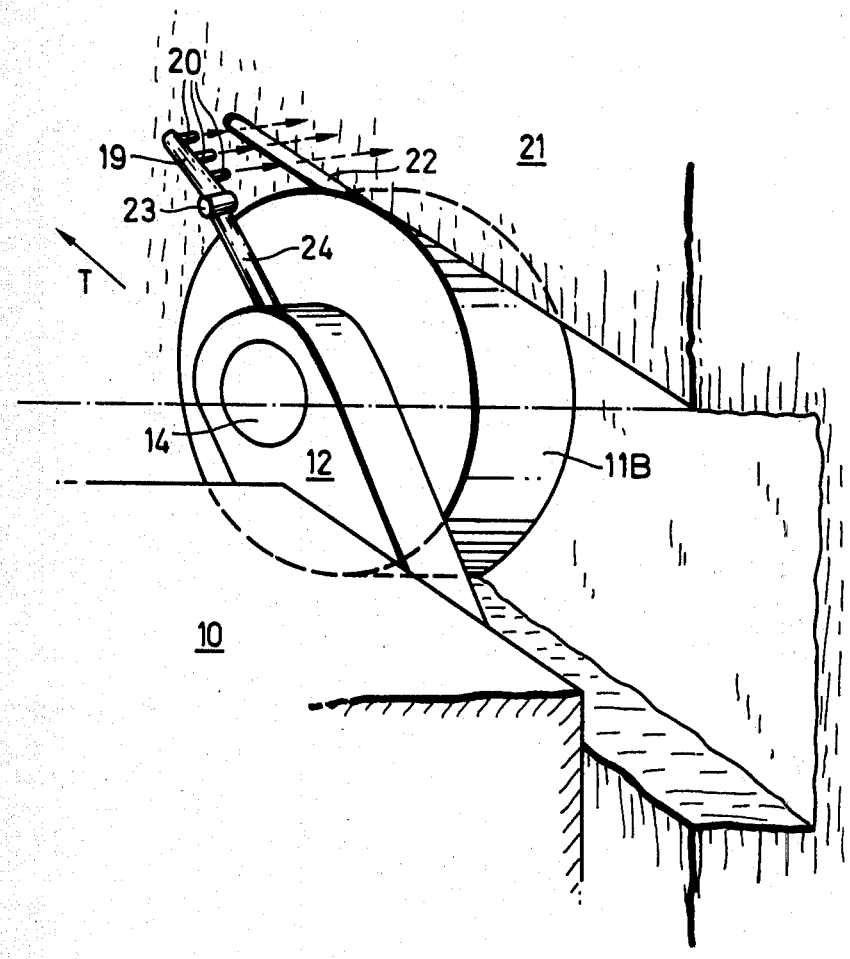
FIG. 4 is a diagrammatic perspective view of part of the machine depicted in FIGS. 1 to 3.

As shown in FIG. 4, the nozzles 20 associated with each drum 11A, 11B are spaced apart along their respective elongate carrier 19 in the direction of movement of the machine (here "T"). The nozzles 20 project high-pressure fluid jets substantially perpendicularly to the mineral face 21 although the nozzles 20 can be slightly inclined.

The carriers 19 position the nozzles 20 so that the fluid jets emitted thereby precede the associated cutting drum 11A, 11B in relation to the particular direction of movement (B or T) of the machine. To achieve this the carriers 19 themselves are pivotable about shafts 23 mounted on support arms 24 and these arms 24 are also pivotable about the axes of the shafts 14 of the cutting drums 11A, 11B. The arms can be pivoted about the shafts 14 and the carriers 19 pivoted about the shafts 23 to bring the nozzles 20 into any desired position. The pivotal movements of the arms 24 and the carriers 19 can be effected by adjustment devices (not shown), such as hydraulic piston and cylinder units or other mechanisms. The high-pressure fluid is fed to the nozzles 20 by way of pipes or conduits 25 each located in a protected position within the associated arms 12, 24. Each conduit 25 can extend from within the shaft 14 to the associated carrier 19 and accommodates the adjustment movements desribed above. A pump which provides the high-pressure fluid is preferably mounted on the body 10 of the machine.

With the machine moving in the direction of arrow B as described, the carrier 19 associated with the upper leading cutting drum 11A positions the nozzles 20 to cut a slot at the roof and mineral face junction 15, 21 in advance of the drum 11A. The carrier 19 associated with the lower lagging cutting drum 11B positions the nozzles 20 to cut a slot at the floor and the mineral face junction 16, 21 in advance of the drum 11B. When the machine reverse its direction of motion to progress in the direction of arrow T, the drums 11A, 11B are swung down and up, respectively, and the arms 24 and the carriers 19 are pivoted also. The position of the carrier 19 associated with the advance cutting drum 11B now causes the nozzles 20, which precede the drum 11B to continue the cutting of the roof slot while the position of the carrier 19 associated with the lagging cutting drum 11A causes the nozzles 20 which precede this drum 11A to continue the cutting of the floor slot. The formation of these preliminary kerfing slots considerably facilitates the winning work by the cutting drums 11A, 11B.

The machine as described is especially suitable for the mining of hard mineral ores which tend to cause considerable wear on the cutting tools or for the mining of coal with an increased output performance.

We claim:

1. A mineral winning machine which employs a rotary cutting means and high-pressure fluid emitting nozzles which provide fluid jets to impinge on a mineral face to produce a preliminary slot in the mineral face, in advance of the cutting means wherein the nozzles are supported by a movable carrier which serves to position the nozzles at various height locations relative to the mineral face.

2. A mineral winning machine comprising a main body which is movable back and forth alongside a mineral face, rotatable cutting drums supported by arms pivotably mounted to the body, high-pressure fluid emitting nozzles supported by carriers each in the vicinity of a respective one of the cutting drums, the carriers each being movably supported on the body by support means adjustable to bring the associated nozzles into selected positions to produce at least one preliminary slot in the mineral face in advance of the associated cutting drum relative to the direction of motion of the machine.

3. A machine according to claim 2, wherein the support means serves to allow the carriers to be brought into positions where the nozzles produce preliminary slots at the junctions between the mineral face and the roof and the floor of the working.

4. A machine according to claim 2, wherein the support means is adjustable to move the carriers vertically.

5. A machine according to claim 2, wherein the nozzles are mounted to their respective carriers to extend perpendicular thereto.

6. A machine according to claim 2, wherein the nozzles are mounted to their respective carriers to extend at an inclined angle thereto.

7. A machine according to claim 2, wherein the carriers are adjustable vertically in respect of the cutting drums.

8. A machine according to claim 2, wherein the support means permits the cattiers to pivot about the axes of rotation of the cutting drums.

9. A machine according to claim 2, wherein the support means comprises arms to which the carriers are pivotably supported for pivoting about axes parallel to the rotational axes of the cutting drums.

10. A machine according to claim 9, wherein said arms of the support means are additionally pivotably supported for pivoting about the axes of rotation of the cutting drums.

11. A machine according to claim 2, wherein supply conduits for conveying high-pressure fluid to the nozzles are located in a protected position at least within the arms supporting the cutting drums.

12. A machine according to claim 2, wherein the carriers are elongate and the nozzles are spaced-apart along their respective carriers.

13. A mineral winning machine comprising a main body which is movable back and forth alongside a mineral face, rotatable cutting drums supported by arms pivotably mounted to the body for movement to alternative cutting positions adjacent to the roof or floor of the mine working, high-pressure fluid emitting nozzles each supported by carriers in the vicinity of a respective one of the cutting drums, the carriers each being movably supported on the body by support means, the carriers and their respective support means being adjustable in relation to each other and to the body to bring the associated nozzles into selected positions to produce at least one preliminary slot in the mineral face at either of said alternative cutting positions in advance of the associated cutting drum relative to the direction of motion of the machine.

* * * * *